US007485076B2

(12) United States Patent
Lee

(10) Patent No.: US 7,485,076 B2
(45) Date of Patent: Feb. 3, 2009

(54) WEIGHT-TRAINING MACHINE HAVING INDEPENDENT POWER GENERATING FUNCTION AND STACK FOR THE MACHINE

(76) Inventor: Byung don Lee, 12-96, Kalhyun-Dong, Eunpyung-ku, Seoul 122-800 (KR)

( * ) Notice: Subject to any disclaimer, the term of this patent is extended or adjusted under 35 U.S.C. 154(b) by 161 days.

(21) Appl. No.: 10/583,467

(22) PCT Filed: Dec. 15, 2004

(86) PCT No.: PCT/KR2004/003294

§ 371 (c)(1),
(2), (4) Date: Jun. 15, 2006

(87) PCT Pub. No.: WO2005/056123

PCT Pub. Date: Jun. 23, 2005

(65) Prior Publication Data

US 2007/0072748 A1 Mar. 29, 2007

(30) Foreign Application Priority Data

Dec. 15, 2003 (KR) ..... 20-2003-0038942
Jan. 20, 2004 (KR) ..... 10-2004-0005197
Nov. 26, 2004 (KR) ..... 10-2004-0105205

(51) Int. Cl.
*A63B 21/062* (2006.01)
*A63B 71/00* (2006.01)

(52) U.S. Cl. ..... 482/99; 482/2

(58) Field of Classification Search ..... 482/2, 482/5, 9, 99, 100, 137, 903
See application file for complete search history.

(56) References Cited

U.S. PATENT DOCUMENTS

| | | | | |
|---|---|---|---|---|
| 4,627,615 | A * | 12/1986 | Nurkowski | 482/98 |
| 4,746,113 | A * | 5/1988 | Kissel | 482/99 |
| 5,037,089 | A * | 8/1991 | Spagnuolo et al. | 482/5 |
| 5,350,344 | A * | 9/1994 | Kissel | 482/98 |
| 5,356,360 | A | 10/1994 | Johns | 482/99 |
| 5,556,362 | A * | 9/1996 | Whipps | 482/98 |
| 5,643,151 | A | 7/1997 | Naimo | 482/98 |
| 5,830,116 | A | 11/1998 | Gautier | 482/99 |
| 6,224,519 | B1 * | 5/2001 | Doolittle | 482/98 |
| 6,350,220 | B1 * | 2/2002 | Milburn et al. | 482/98 |
| 7,060,010 | B2 * | 6/2006 | Daniel | 482/94 |
| 2005/0143228 | A1 * | 6/2005 | Lee | 482/94 |

* cited by examiner

*Primary Examiner*—Loan H Thanh
*Assistant Examiner*—Allana Lewin
(74) *Attorney, Agent, or Firm*—J.C. Patents

(57) ABSTRACT

Disclosed is a weight-training machine having an independent power generating function, which may improve the exercising effect, control the weight caused by a solenoid without external power together with keeping a conventional button manner and eliminate a space limitation for installation of the machine. The weight-training machine has an independent power generating function so as to minutely adjust an exercising load without supply of external power. An operation distance between a fixing plate and a push button of a fixing device is minimized to allow one-touch manipulation. The solenoid may be operated with a lower electric energy. Thus, stacks are not shaken in right/left or front/rear direction on the basis of the fixing plate and the insert groove when a stack selected by the fixing plate and stacks upon the stack are moved up and down at the same time.

6 Claims, 11 Drawing Sheets

[Fig. 1]
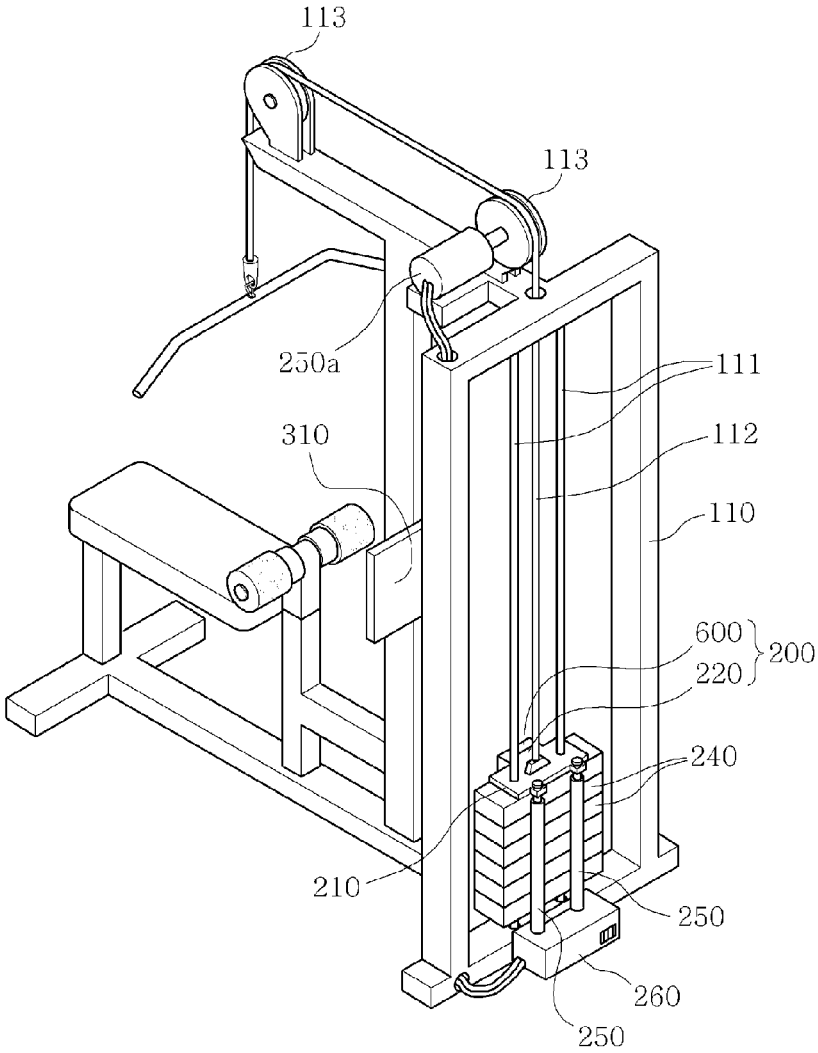
[Fig. 2]
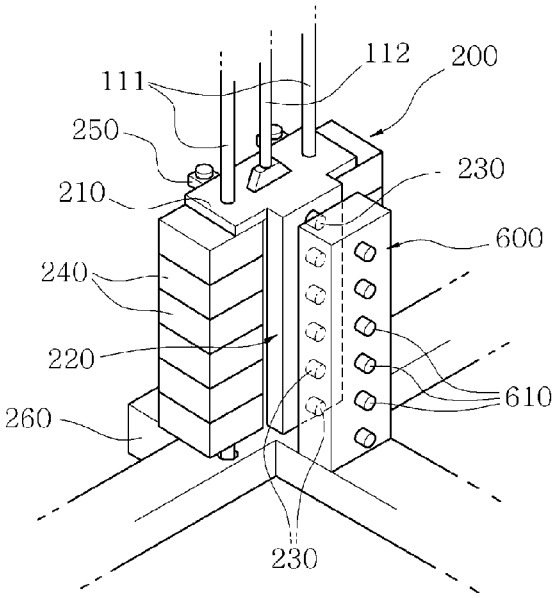

[Fig. 3]
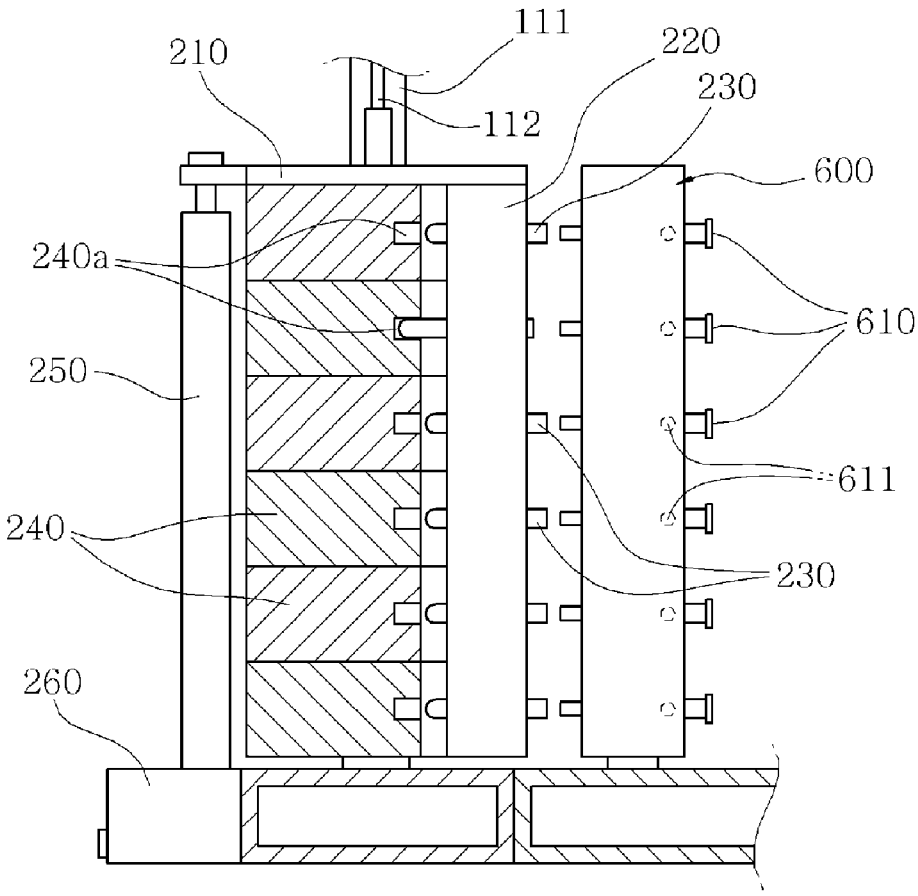
[Fig. 4]
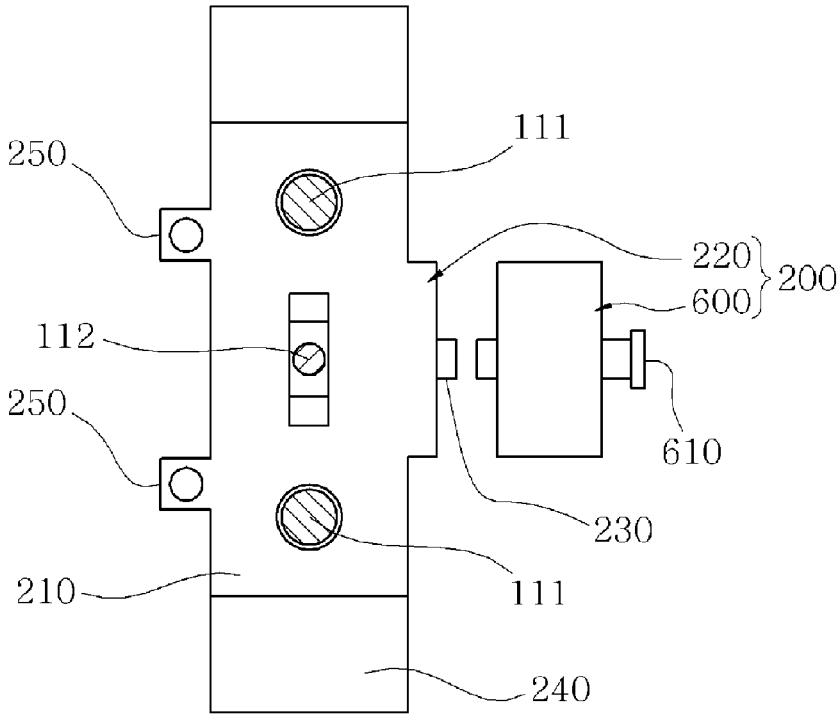

[Fig. 5]
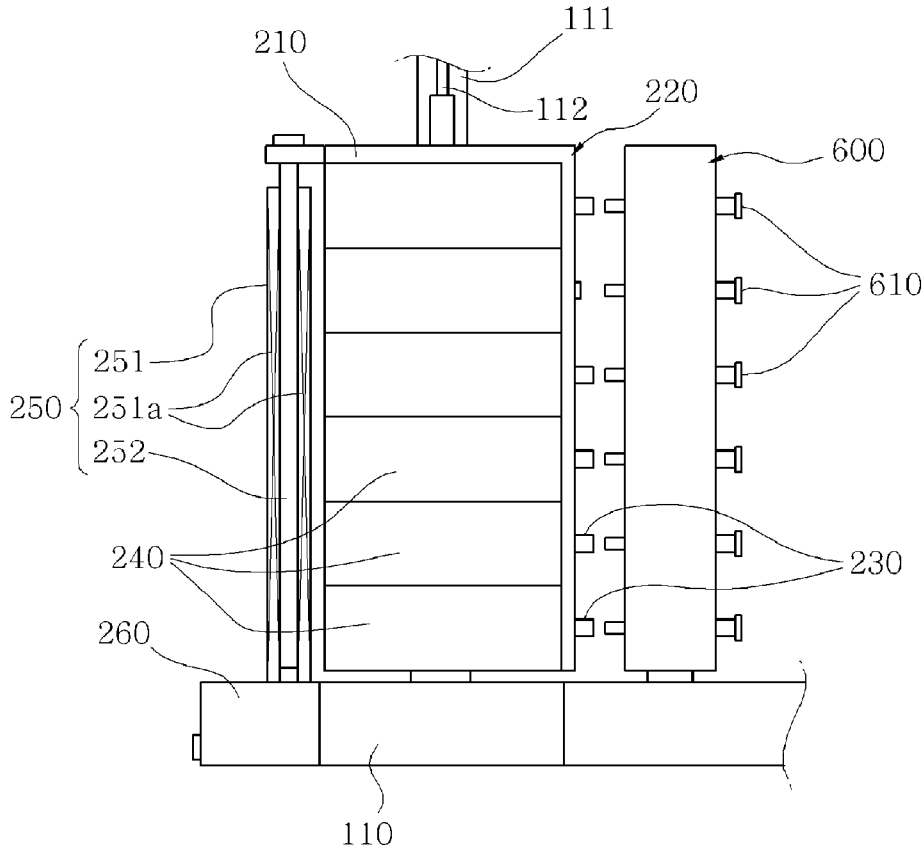
[Fig. 6]
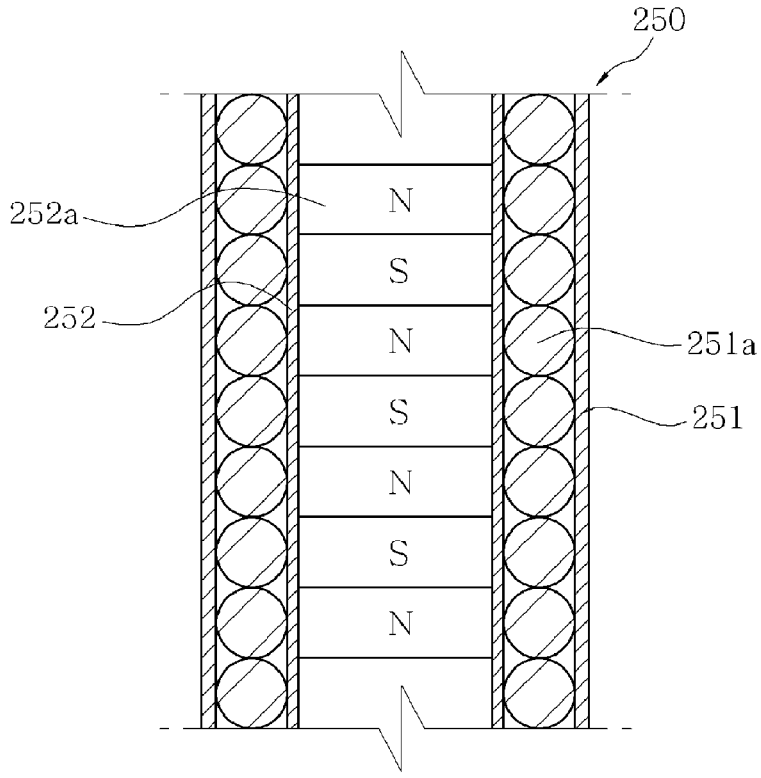

[Fig. 7]
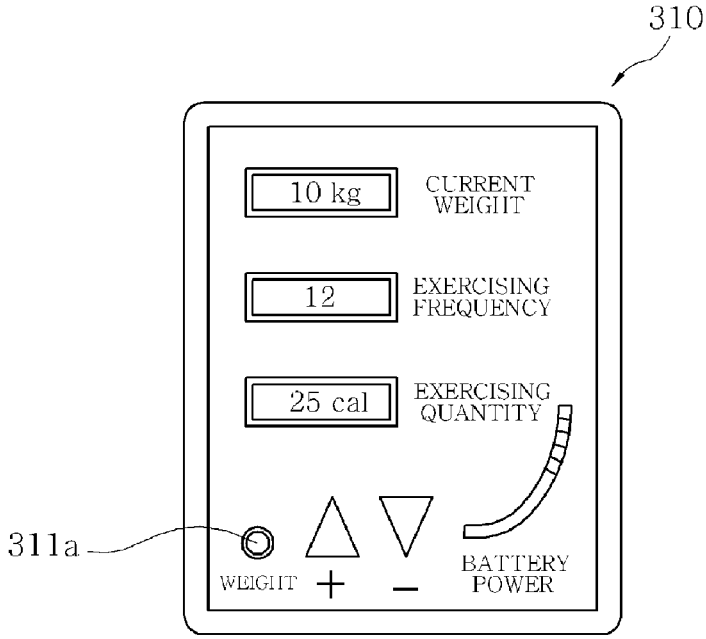
[Fig. 8]
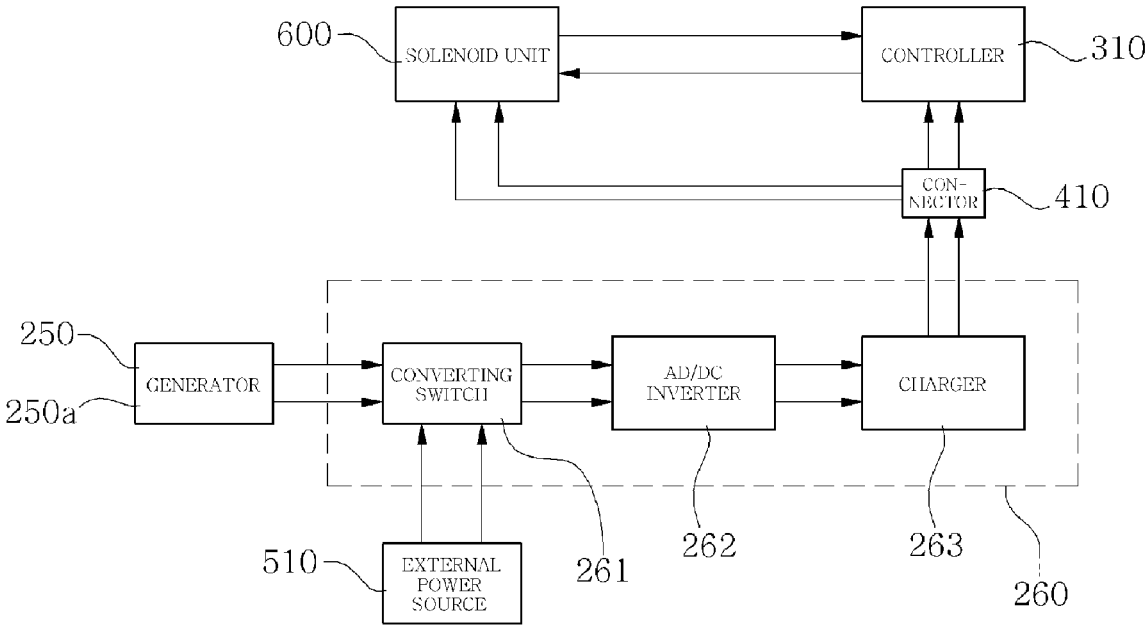

[Fig. 9]
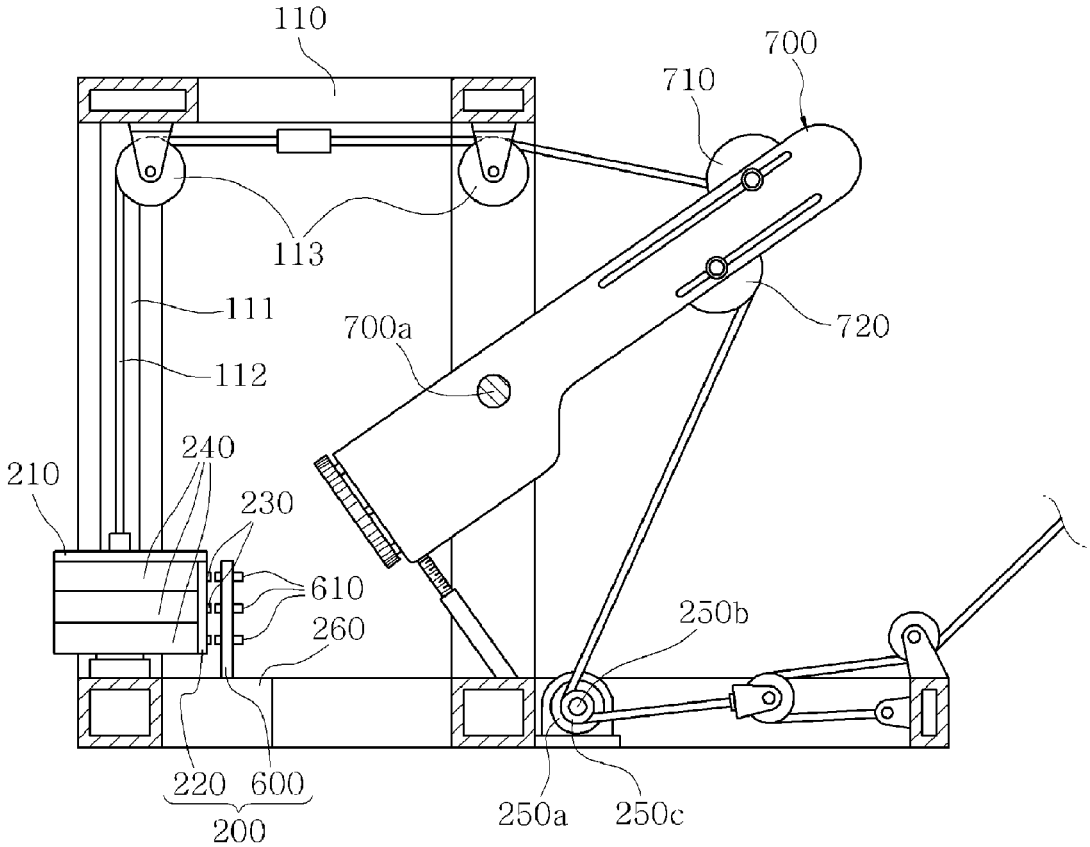

【FIG.10】
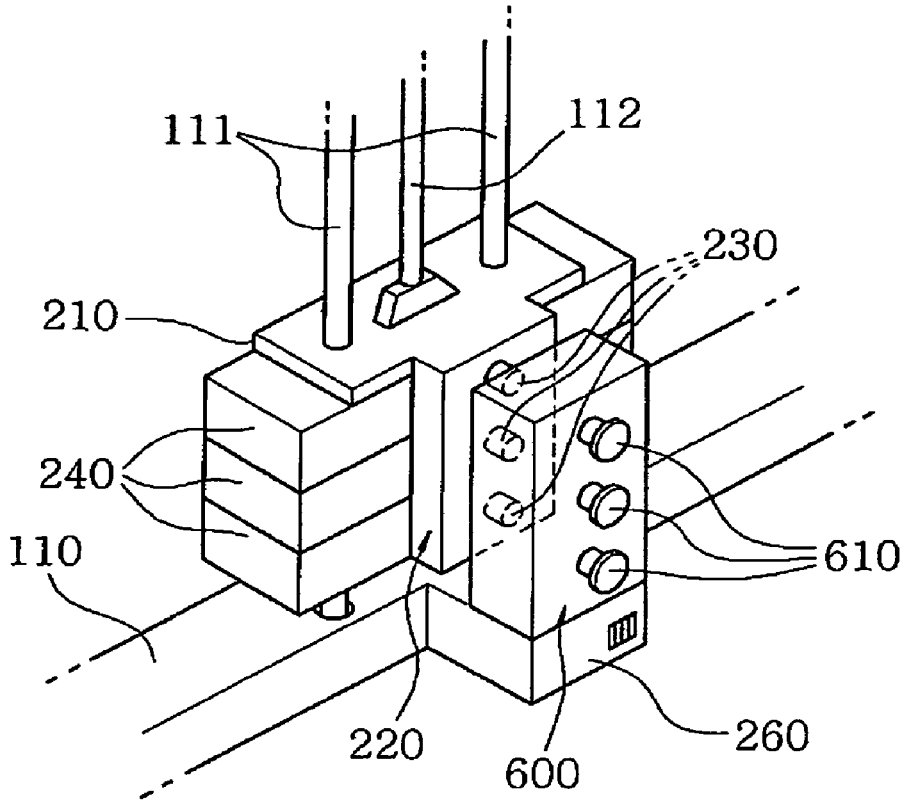
【FIG.11】
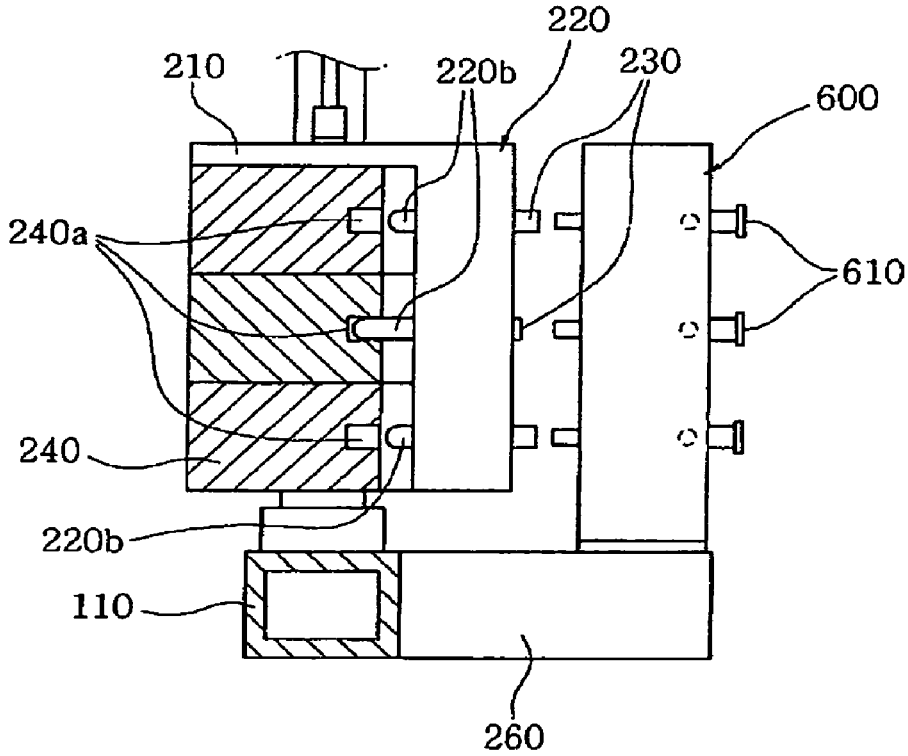

[Fig. 12]
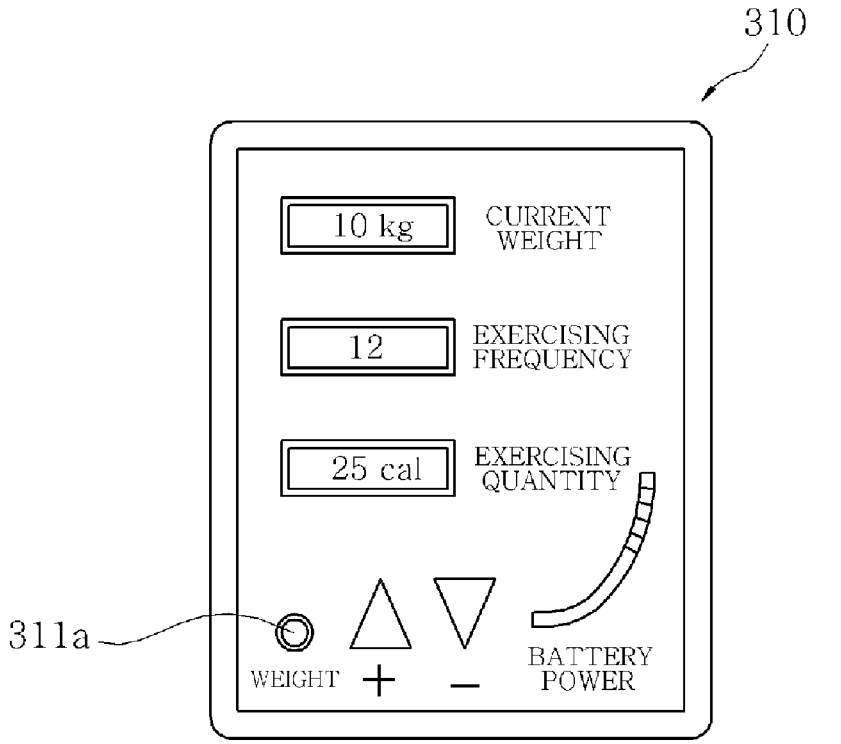

[Fig. 13]
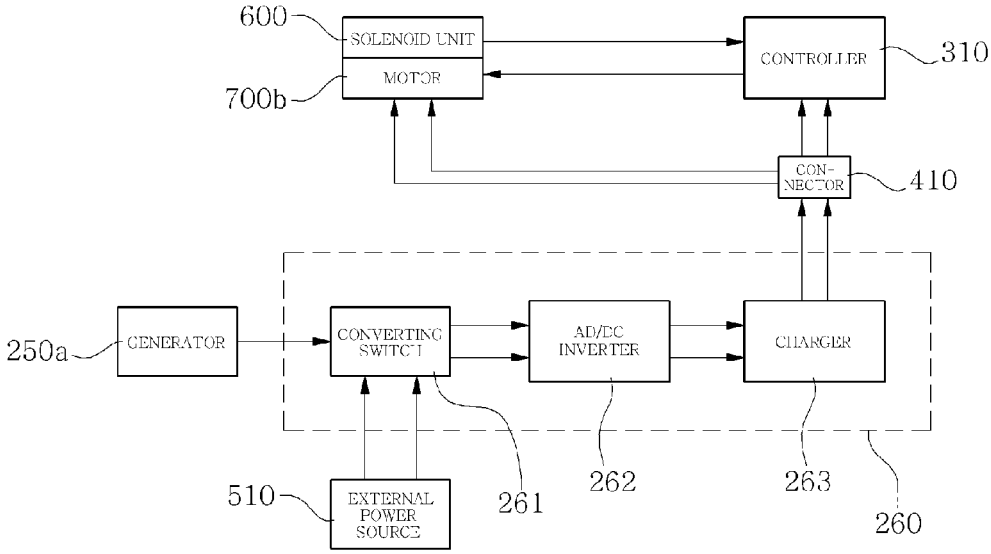
[Fig. 14]
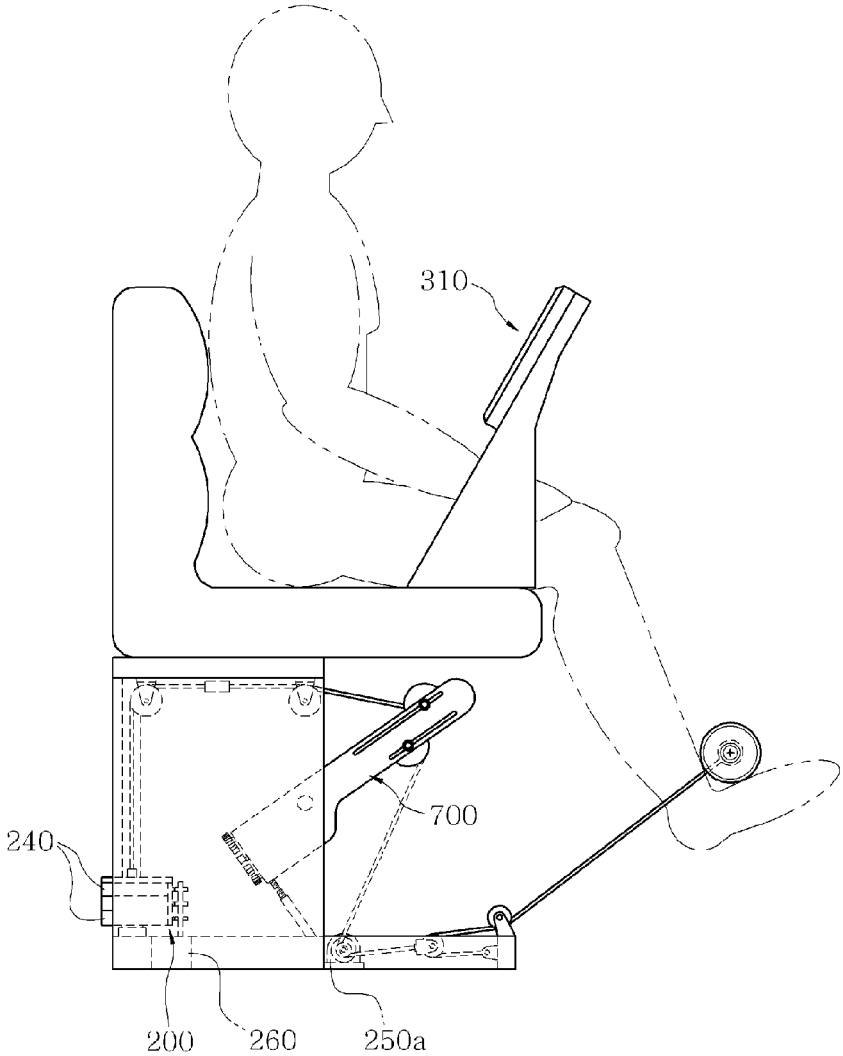

[Fig. 15]
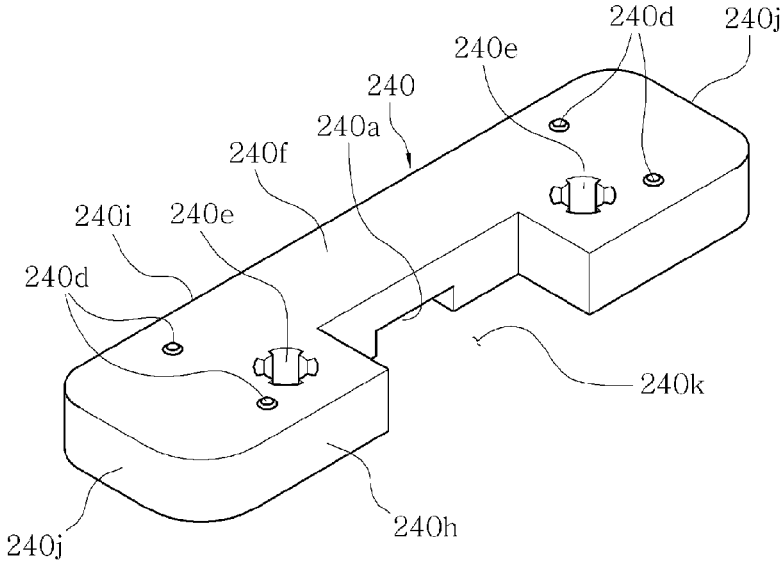
[Fig. 16]
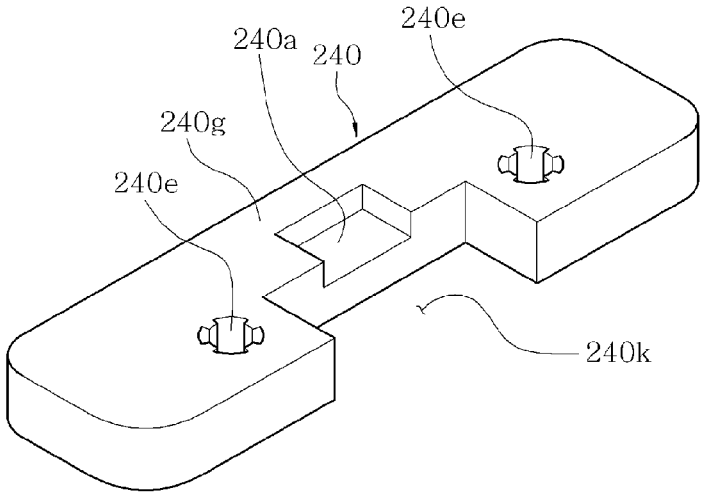
[Fig. 17]
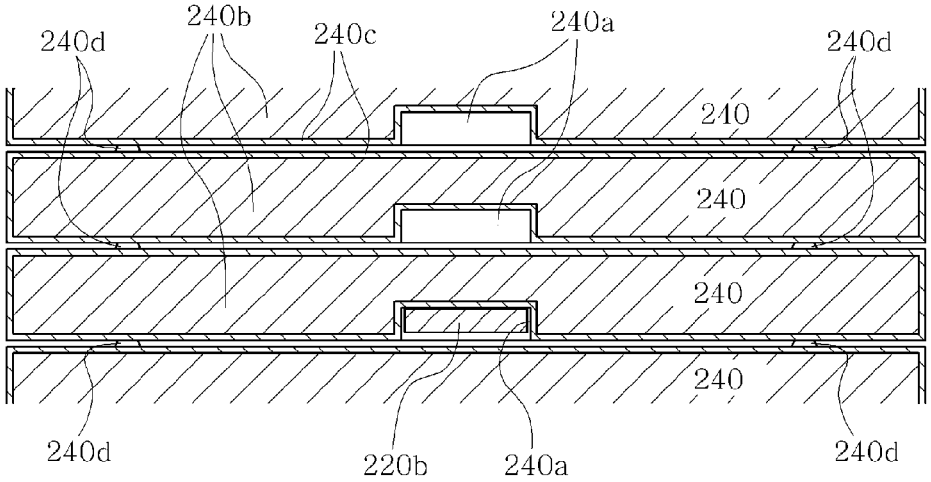

[Fig. 18]
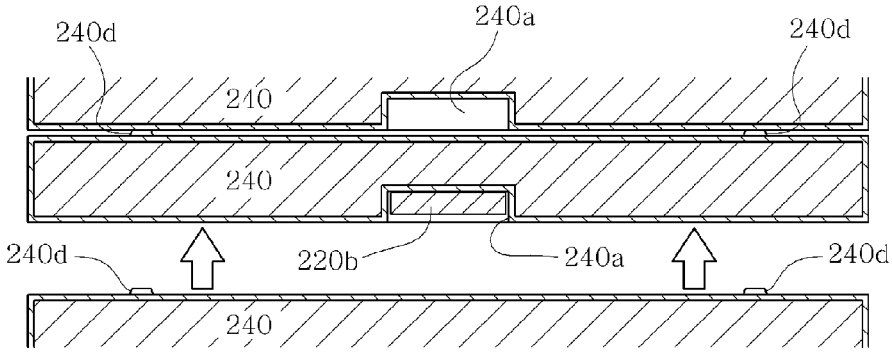
[Fig. 19]
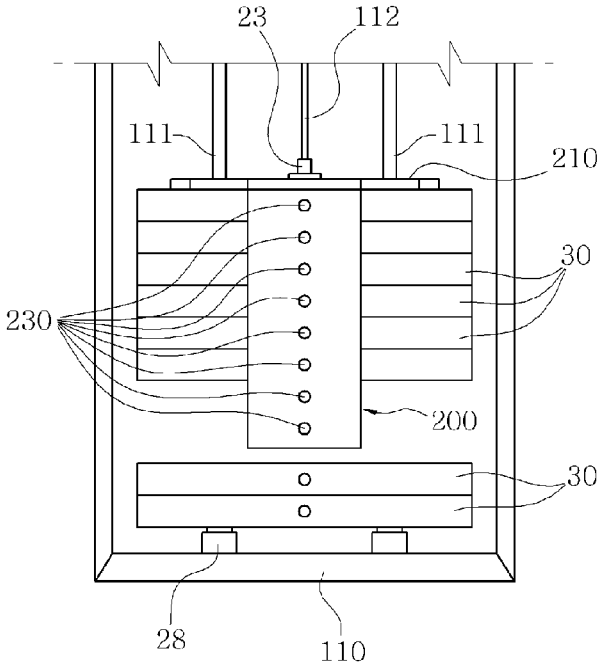
[Fig. 20]
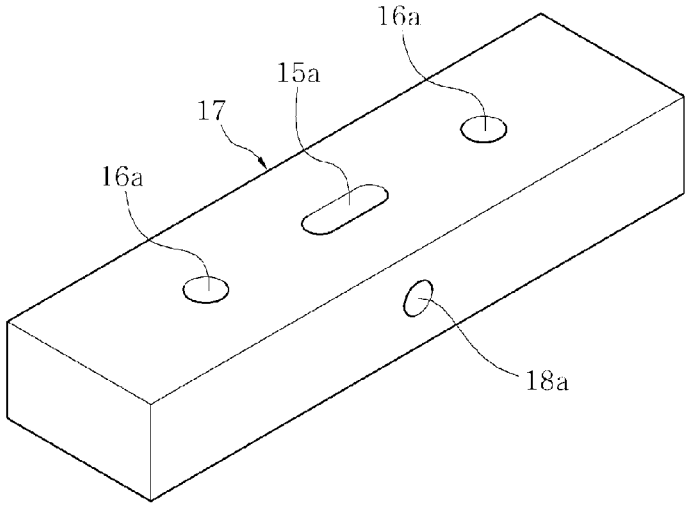

[Fig. 21]
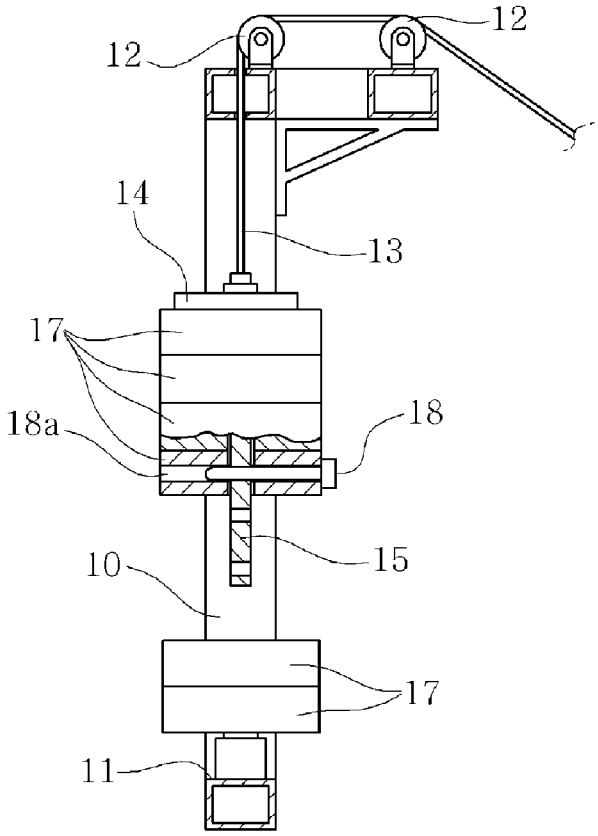
[Fig. 22]
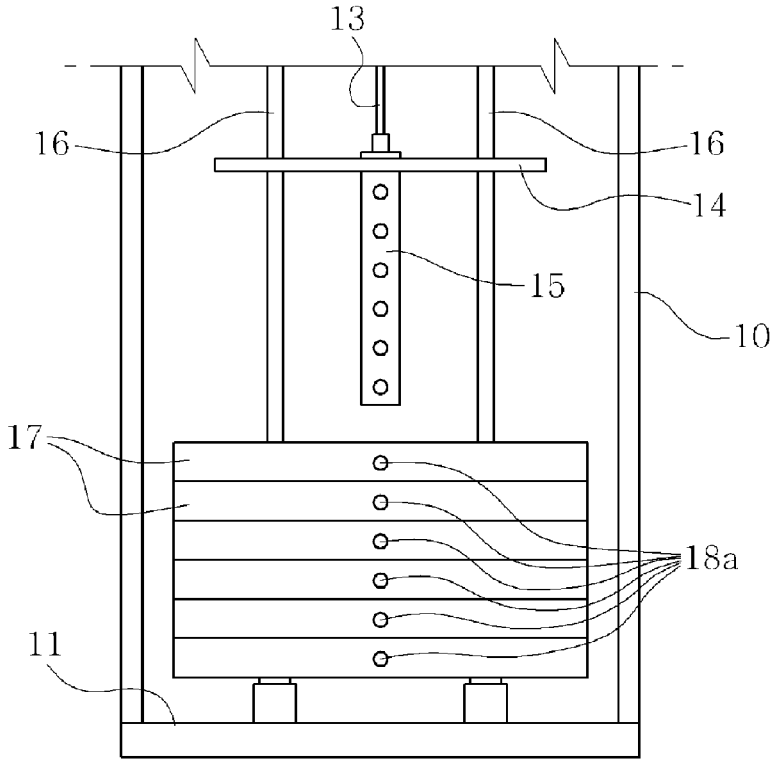

WEIGHT-TRAINING MACHINE HAVING INDEPENDENT POWER GENERATING FUNCTION AND STACK FOR THE MACHINE

TECHNICAL FIELD

The present invention is an improvement of Korean Patent No. 425814 and Korean Patent Application No. 2003-49609, and the present invention particularly relates to a weight-training machine having an independent power generating function, wherein a solenoid is separated from the button unit disclosed in Korean Patent No. 425814 and positioned in front of the button unit and a pair of generators having a rod shape are installed at the rear of stacks with a certain distance so as to balance the whole machine to improve the exercising effect, wherein the solenoid controls weight without external power together with keeping a conventional button manner so as to eliminate a space limitation for installation of the machine, wherein, in the compact weight-training machine of Korean Patent Application No. 2003-49609 that is very advantageous in space utilization than conventional ones since a weight adjustment device occupies very small space, an exercising load may be minutely adjusted without supply of external power, a groove is formed in a front center of the stack used in the machine so that a fixing device is inserted therein, a groove is formed in a front lower center of the groove so that a fixing plate operated by a push button is inserted therein, an operation distance between the fixing plate and the push button of the fixing device is minimized to allow one-touch manipulation by positioning the groove at the center of gravity of the stack, a lower electric energy is required in applying a pressing manner using a solenoid or a manner using a wire, and the fixing plate operated by the push button has a cubical shape so that stacks are not shaken in right/left or front/rear direction on the basis of the fixing plate and the insert groove when a stack selected by the fixing plate and stacks upon the stack are moved up and down at the same time.

BACKGROUND ART

The machine disclosed in Korean Patent No. 425814 issued to the inventor of this invention has a plurality of stacks to be laminated. The stacks are supported by a pair of guides so as to move up and down. A button unit having buttons corresponding to the number of stacks is formed in front of the stacks. The button is advanced by a solenoid to be inserted into the insert groove of the stack, and then retracted by a button fixing/releasing device installed in another button to return to its original position when another button is advanced. The button unit is fixed in front of a plate positioned above the stack.

In addition, as a selected one of the solenoids makes an adjacent button advanced, the selected stack is moved up or down along the guide by means of a wire when a user pulls or releases a handle, as an example.

However, such a weight-training machine inevitably requires an external power source to operate the solenoid, so it should be installed at a place where external power may be supplied.

In addition, since the button unit having solenoid and button is positioned at a front center of the stack, the center of gravity is inclined forward on the basis of a bearing of the guide when the stack moves up and down. Such an inclined load causes mechanical friction applied to the bearing, thereby deteriorating the exercising sense.

In addition, power lines of the solenoids are fluctuated up and down when the stack moves up and down, thereby giving bad appearance.

The compact weight-training machine disclosed in Korean Patent Application No. 2003-49609 filed by the inventor of this invention is configured so that a weight adjustment device has a minimum length by crossing two moving devices (a weight unit and an exercising unit) in opposite directions to each other so as to maximize the leverage effect. Thus, the machine occupies a small space, advantageously in space utilization rather than conventional ones. In addition, the machine has an advantage that a length of the wire that should be pulled by a user is not changed though a point of action is changed.

However, a motor-driven weight-training machine among such machines requires an external power source to operate the motor, thereby causing space limitation.

In addition, since a significant amount of electricity is consumed to operate the motor of the weight adjustment deice, the machine cannot use an independent power generating mode.

A conventional stack 17 has a cubical shape as shown in FIG. 20. A fixture insert hole 18*a* is formed in the center of the front surface toward a rear side in a certain depth. Meanwhile, a fixing rod insert hole 15*a* is perpendicularly formed through the center of the upper surface so as to be crossed with the fixture insert hole 18*a*. In both sides of the fixing rod insert hole 15*a*, guide holes 16*a* are formed to pass through vertically.

In addition, as shown in FIG. 22, a plurality of stacks are laminated on a base 11. The stacks are laminated to be capable of moving up and down along guides 16. A fixing rod 15 of a plate 14 combined to the guides 16 is inserted into the fixing rod insert hole 15*a*.

In addition, as shown in FIG. 21, a fixture 18 is inserted into the fixture insert hole 18*a* to pass through a hole of the fixing rod 15. Thus, the corresponding stack 17 and other stacks 17 laminated thereon are used for exercising.

However, such a stack 17 has a disadvantage that the fixture 15 is not easily inserted if it is once separated for weight adjustment since the fixture insert hole 18*a* has a small diameter.

In addition, the fixture 18 may be separated from the stack 17 even during exercising. In this case, no load is applied to the exercising handle connected to a wire 13, thereby causing various accidents. For example, a user may fall down backward from the seat or the handle may hit the head or the face of the user, depending on the kind of the weight-training machine.

In this point of view, the inventor discloses an improvement that solves such problems in Korean Patent No. 425814.

As shown in FIG. 19, a weight adjustment device 200 having buttons 230 corresponding to the number of stacks 30 is installed at a front center of the stacks 30. The buttons 230 are moved forward or backward manually or automatically (using a solenoid) so that a fixing plate of the buttons 230 is inserted into an insert hole. Thus, it solves the conventional inconveniences that, after being released from the fixture insert hole 18*a*, the fixture 18 of the stack 17 should be inserted again into a fixture insert hole 18*a* of another stack 17, and that the fixture 18 is separated from the fixture insert hole 18*a* during exercising to cause accidents.

In addition, an upper end of the weight adjustment device 200 is combined in front of the plate 210, and a top of the plate 210 is fixed to the stack 20. Thus, there is no need to separately install the conventional fixing rod 15.

However, since the stack 30 has the circular insert hole at the center of the front surface and the fixing plate has a circular rod shape, the stacks 30 are eccentrically inclined in right and left directions during vertical movement. In addition, since the fixture 18 should be provided with at least an operation distance to pass the center of gravity of the stack 30 on the basis of front and rear of the stack 30, the machine requires more force in comparison to a button switch manner, namely a one-touch manipulation.

In the figures, reference numeral 10 designates a support, 12 designates a pulley, 13 and 112 designate wires, and 23 designates a wire fixture, respectively.

DISCLOSURE OF INVENTION

Technical Problem

The present invention is designed in consideration of the drawbacks of the prior art, and it is an object of the invention to provide a weight-training machine having an independent power generating function, which may improve the exercising effect, control the weight by means of a solenoid without external power together with keeping a conventional button manner, and eliminate a space limitation for installation of the machine, wherein, in a conventional compact weight-training machine, proposed by the inventor, that is very advantageous in space utilization than conventional ones since a weight adjustment device occupies very small space, the weight-training machine may have an independent power generating function so as to minutely adjust an exercising load without supply of external power, an operation distance between a fixing plate and a push button of a fixing device is minimized to allow one-touch manipulation, the solenoid may be operated with a lower electric energy, and stacks are not shaken in right/left or front/rear direction on the basis of the fixing plate and the insert groove when a stack selected by the fixing plate and stacks upon the stack are moved up and down at the same time.

Technical Solution

In order to accomplish the above object, the present invention provides a weight-training machine having an independent power generating function, which includes a plurality of stacks moving up and down by means of a pair of guides mounted vertically, a button unit disposed at a front center of the stacks and having the number of solenoid buttons corresponding to the number of the stacks and buttons inserted into insert holes of the stacks, and a wire guided by pulleys mounted to a frame, wherein a solenoid unit having the solenoid buttons is separated from the button unit so that the solenoid buttons are installed to a position adjacent to heads of the buttons, wherein the buttons are moved forward and backward electrically or manually, wherein a pair of generators having a rod shape are installed at both rear sides of the stacks so as to be parallel to each other vertically with a predetermined distance, and wherein a power supply is installed below the generators so that the power supply is electrically connected to the generators and the solenoid unit.

In another aspect of the invention, there is provided a weight-training machine having an independent power generating function, in which a stack is mounted to a main body to be supported by guides and movable up and down by means of a wire, and the wire is guided by pulleys mounted to the main body so that a point of action is adjusted by a weight adjustment device to control a load, wherein the stack is uniformly divided vertically into several parts, wherein an insert groove is formed at a lower center of a front surface of each stack, wherein a fixing plate capable of moving forward and backward is inserted into the insert groove by a solenoid button and a button working together with the solenoid button to select a weight, wherein a generator is installed to a frame at a position below the weight adjustment device so as to generate power by the wire passing via a moving device of the weight adjustment device.

In still another object of the invention, there is also provided a stack for a weight-training machine having a weight adjustment device in which the number of buttons corresponding to the number of stacks is installed at a front center of the stacks, and in which a fixing plate is moved forward or backward by automatic or manual operation of the buttons so that the fixing plate is inserted into or taken out of the insert groove, wherein an insert recess is formed at a front center of the stack so that the weight adjustment device is inserted therein, wherein the fixing plate has a rectangular plate shape, wherein the insert groove is formed at a lower center of a side that forms a front surface of the insert recess so that the fixing plate is inserted therein.

BRIEF DESCRIPTION OF THE DRAWINGS

These and other features, aspects, and advantages of preferred embodiments of the present invention will be more fully described in the following detailed description, taken accompanying drawings. In the drawings:

FIG. 1 is a perspective view showing a weight-training machine according to the present invention;

FIG. 2 is a perspective view showing a weight adjustment device of the machine in FIG. 1;

FIG. 3 is a side sectional view showing the weight adjustment device of FIG. 2;

FIG. 4 is a plane view showing a weight adjustment device and a generator of the machine according to the present invention;

FIG. 5 is a sectional view schematically showing the generator of the machine according to the present invention;

FIG. 6 is a sectional view showing inner structure of the generator of FIG. 5;

FIG. 7 is a front view showing a controller of the machine according to the present invention;

FIG. 8 is a block diagram showing that power is supplied to the weight-training machine according to the present invention;

FIG. 9 is a front view showing a weight-training machine according to another embodiment of the present invention;

FIG. 10 is a perspective view showing a stack and a weight adjustment device of the machine according to another embodiment of the present invention;

FIG. 11 is a sectional view showing the stack and the weight adjustment device of FIG. 10;

FIG. 12 is a front view showing a controller according to another embodiment of the present invention;

FIG. 13 is a circuit diagram showing a weight-training machine according to another embodiment of the present invention;

FIG. 14 shows how the weight-training machine according to another embodiment of the present invention is used;

FIG. 15 is a perspective view showing a stack according to the present invention;

FIG. 16 is a perspective bottom view showing the stack according to the present invention;

FIGS. 17 and 18 are sectional views showing that the stacks according to the present invention are laminated;

FIG. 19 is a front view showing a weight-training machine to which the stacks according to the present invention are installed;

FIG. 20 is a perspective view showing a conventional stack;

FIG. 21 is a side view showing a weight-training machine to which conventional stacks are installed; and FIG. 22 is a front view showing a weight-training machine to which conventional stacks are installed.

BEST MODE FOR CARRYING OUT THE INVENTION

Hereinafter, the present invention will be described in detail with reference to the accompanying drawings.

FIGS. 1 and 2 shows a weight-training machine having an independent power generating function according to the present invention. The machine includes a pair of guides 111 installed perpendicular to a frame 110. A plurality of stacks 240 are vertically arranged to the frame in parallel so as to be moved up and down along the guides 111. In front of the guides 111, a button unit 220 having buttons 230 corresponding to the number of stacks 240 is installed. In front of that, a solenoid unit 600 having solenoid buttons 610 corresponding to the number of buttons 230 is installed. The above components configure a weight adjustment device 200.

In the above configuration, an end of the solenoid button 610 is positioned adjacent to the head of the button 230. Each solenoid button 610 is provided in correspondence to each button 230. A sensor 611 for sensing operation of the solenoid button 610 is installed to the solenoid unit 600 as shown in FIG. 3.

Such a sensor 611 senses the solenoid button 610 even when it is operated manually, and displays a current exercising weight to a controller 310 as shown in FIG. 7.

In addition, a pair of generators 250 having a rod shape are vertically installed in parallel at both rear sides of the stack 240. A power supply 260 is installed to a lower portion of the generator. The generators 250, the power supply 260 and the solenoid unit 600 are electrically connected.

A button unit 220 and the generator 250 are fixed to the plate 210 positioned at the top of the stack 240. The plate 210 is guided by the guides 111 so that it may be pulled up by a wire 112. The wire 112 has a handle installed to its end, and the wire 112 is guided by a plurality of pulleys 113 mounted to the frame 110 so that the selected stacks 240 may be moved up and down along the guides 111 when a user pulls or releases them.

A generator 250*a* is installed to one of the pulleys 113 that guide the wire 112 so that it generates power by means of pulling of the wire 112. A one-directional rotating bearing is installed between an axis extended from the pulley and an axis of the generator 250*a* so that the generator 250*a* may rotate only in one direction for generation regardless of the rotating direction of the pulley.

The button unit 220 for adjusting weight in a solenoid manner as mentioned above is now described in brief. As shown in FIG. 3, in order to adjust a weight with a plurality of accumulated stacks 240, the solenoid button 610 of the solenoid unit 600 that makes the button 230 be inserted into an insert groove 240*a* of the stack 240 is moved forward/backward by means of electromagnetic force by control of the controller 310 as shown in FIG. 7 so that the number of stacks 240 corresponding to the selected weight are combined. The button 230 inserted into the insert groove 240*a* is then moved back by means of a button fixing/releasing device installed therein to return to its original position as another button 610 is inserted into the insert groove 240*a* of the stack 240.

The weight-training machine having such a basic configuration has the generators 250 positioned both rear sides of the button unit 220 combined for adjusting weight by binding the selected number of stacks 240 perpendicularly at one side of the plate 210, differently from the conventional one.

In addition, the power supply 260 is provided below the generator 250.

The generator 250 includes a tube 251 having a coil 251*a* mound in contact with the inner side, and a magnetic rod 252 combined to the tube 251 to be movable in a length direction along the inside, as shown in FIGS. 5 and 6.

The magnetic rod 252 is composed of a plurality of permanent magnets 252*a* so that positive and negative poles are alternately laminated. Thus, when the magnetic rod 252 reciprocates in a length direction along the inside of the coil 251*a*, the movement of the permanents 252*a* generates power.

In addition, the power supply 260 to which the tube 251 of the generator 250 is combined includes a converting switch 261 for selecting power supply from the generator 250 therein or from an external power source 510, an inverter 262 for converting AC into DC, and a charger 263 for charging power converted into DC by the inverter 262.

The magnetic rod 252 of the generator 250 configured as mentioned above is vertically combined to one side of the plate 210, and the tube 251 of the generator 250 is perpendicularly combined to the upper portion of the power supply 260 so as to be movable up and down along the inside of the tube 251.

The generator 250 of the present invention, configured as above, generates power since the magnetic rod 252 including the permanent magnets 252*a* reciprocates in a length direction in the tube 251 having the coil 251*a* wound therein when a user moves the stack 240 up and down for exercise. The generator 250*a* positioned at the pulley 113 is rotated in one direction to generate power regardless of the rotating direction of the pulley 113.

The power generated by the generators 250 and 250*a* is used for operating the solenoid button 230 of the weight adjustment device 200 manipulated by the controller 310.

The controller 310 displays exercising frequency and exercising quantity of a user together with a weight on its display window, like the conventional weight-training machine.

In the present invention, the controller 310 has a button (not shown) used for weight adjustment. At this time, if a user sets a weight necessary for exercise using the weight adjustment button, a processor of the controller operates the corresponding solenoid button 610 of the weight adjustment device 200 so as to control weight of the stacks 240.

In addition, the controller 310 has a battery power display (not shown) for displaying a currently charged power of the charger 263 generated by the generators 250 and 250*a*. If it is displayed on the battery power display that there is no charged battery power, the charger 263 is charged using the external power source. A sensor 31 la is provided to one side of the charger 263 to prevent unnecessary power consumption. This sensor 311*a* detects that a user is in an exercising position so that the controller 310 is operated. If the user moves of from the exercising position, the sensor 311*a* isolates power supply to the controller 310 so as to prevent unnecessary power consumption.

In the present invention configured as above, the button unit 220 having the button 230 in the front center of the stack 240 on the basis of the plate 210 positioned at the top of the stack 240, and a pair of generators 250 of a rod shape are positioned at both rear sides, thereby ensuring overall balance. Thus, when the selected stack 240 and other stacks 240 positioned above it move up and down along the guides 111, weight of the stacks 240 is not inclined to improve the exercising effect.

As for the circuit configuration, as shown in FIG. 8, the generator 250 and the external power source 510 are connected to the converting switch 261 of the power supply 260, and a connector 410 is connected to the charger 263 of the power supply 260 so as to supply power to the controller 310 and the solenoid button 230 of the weight adjustment device 200.

The charger 263 may be mounted between the generator 250 or the external power source 510 and the converting switch 261, or between the converting switch 261 and the inverter 262.

At this time, the charger 263 may be an AC charger or a DC charger depending on its mounting position.

In addition, the controller 310 and the solenoid unit 600 are configured so that operation of the solenoid unit 600 may be controlled by means of signal transmission in a wired manner.

That is to say, the generators 250 and 250*a* generate power while a user is exercising, and the generated power is supplied to the controller 310 and the solenoid unit 600.

In addition, the button 230 of the button unit 220 is operated in two ways: an electric manner in which a power is supplied to the solenoid button 610 for operation, and a manual manner in which a user pushes the solenoid button 610 without using electric power.

FIG. 9 shows a weight-training machine according to another embodiment of the present invention. This machine has a basic configuration identical to the compact weight-training machine disclosed in Korean Patent Application No. 2003-0049609 filed by the inventor of this invention, in which the stack 240 is supported to the frame 110 by means of the guides 111 so as to be vertically movable by the wire 112.

The wire 112 is pulled to adjust its length by the weight adjustment device 700 with being guided by a plurality of pulleys 113 mounted to the frame 110. The weight adjustment device 700 is mounted to the frame 110 with being inclined a certain angle by means of a rotary shaft 700*a* so as to move along an arc within a certain range on the center of the rotary shaft 700*a*.

In addition, the weight adjustment device 700 includes moving devices 710 for adjustment of action points for the exercising load.

The wire 112 installed via the moving devices 720 is passing through the generator 250*a* installed to the frame 110 on the bottom. The generator 250*a* generates power by means of operation of the wire 112. There may be installed one or more generator 250*a*.

The weight-training machine basically having such a configuration includes a plurality of stacks 240, each having an insert groove 240*a*, as shown in FIGS. 10 and 11, differently from the compact weight-training machine.

The insert groove 240*a* is formed at the center of gravity of each stack 240, preferably at a center end of the side that forms a front surface of each stack 240.

In the present invention, though it is described that three stacks 240 are provided, at least two stacks may be used in the machine.

In the present invention, the number of stacks 240 is different from that of the conventional compact weight-training machine in consideration of an amount of power generated by independent power generation. That is to say, it is directed to reducing an energy consumption used in a motor 700*b* of the weight adjustment device 700, considering that an amount of generated power is not great.

To describe it in more detail, the motor 700*b* mounted in the weight adjustment device 700 moves the moving devices 710 and 720 to shift an action point in order to control weight by means of the weight adjustment device 700, so the exercising load selected by the user is controlled.

At this time, the motor 700*b* is operated to move the moving devices 710 and 720. A driving force of the motor 700*b* is proportional to the amount of power.

Thus, if an amount of generated power is insufficient, it may not satisfy the driving force of the motor 700*b*, thereby not easily performing the weight adjustment.

In order to solve this defect, the stacks 240 are divided into several parts so that the moving devices 710 and 720 of the weight adjustment device 700 moves a shorter distance, thereby reducing the energy consumption of the motor 700*b*.

For example, the stack used in the conventional compact weight-training machine is made of one body. Thus, in order to adjust the exercising load of 1 to 90 kg, a moving distance of the moving devices 710 and 720 should be at least corresponding to 1 to 90 kg, which requires a large amount of driving force to the motor 700*b*.

However, in the present invention, the stacks are divided into three parts: an upper stack for 1 to 30 kg, a middle stack for 31 to 60 kg, and a lower stack for 61 to 90 kg. Thus, the stacks may be divisionally selected in a solenoid manner that requires an energy consumption far less than a motor-driving manner, so the moving distance of the moving devices 710 and 720 is reduced one to three, compared than the conventional one. In addition, the driving force of the motor 700*b* is also reduced one to three.

As mentioned above, the weight adjustment device 200 includes the required number of stacks 240 so that the stacks 240 are engaged to be movable up and down.

The weight adjustment device 200 is operated by a manner using the solenoid button 610 that consumes a small amount of electricity, like that disclosed in Korean Patent Application No. 2002-0004746, filed by the inventor of this invention.

This operating manner may be briefly described as follows. In order to adjust weight using the accumulated stacks 240, a fixing plate 220*b* inserted into the insert groove 240*a* is moved into or out of the insert groove 240*a* as the button 230 of the button unit 220 moves forward or backward by means of the solenoid button 610. The fixing plate 220*b* has a rectangular plate shape.

The solenoid unit 600 having such a solenoid button 610 is vertically installed above the power supply 260, and binds the number of stacks 240 corresponding to the weight selected by the controller 310.

The power supply 260 includes a converting switch 261 for selecting power supply from the generator 250 therein or from an external power source 510, an inverter 262 for converting AC into DC, and a charger 263 for charging power converted into DC by the inverter 262, as shown in FIG. 13.

The generator 250*a* configured as above is a general generator in which the wire is wound around a pulley 250*c* of a shaft 250*b* so that rotors may rotate.

The generator 250*a* is used for operating the motor 700*b* of the weight adjustment device 700 and the solenoid button 610 mounted in the solenoid unit 600 of the weight adjustment device 200, which is controlled by the controller 310, as shown in FIG. 12.

The controller 310 displays a weight, an exercising frequency and an exercising quantity on its display window, like the conventional one.

In the present invention, the controller 310 has a button (not shown) for weight adjustment. At this time, if a user sets a weight required for exercising with the weight adjustment button, a processor of the controller 310 calculates the operation number of the solenoid button 610 of the weight adjustment device 20 for load adjustment of the stacks 240 and a moving distance of the moving devices 710 and 720 of the weight adjustment device 700 in order to find an action point of force. Reference numeral 311*a* designates a sensor.

In addition, the controller 310 includes a battery power display (not designated by a reference numeral) for displaying a battery power generated by the generator 250*a* and charged in the charger 263.

As for the circuit configuration of the machine in this embodiment, as shown in FIG. 13, the generator 250*a* and the external power source 510 are connected to the converting switch 261 of the power supply 260, and a connector 410 is connected to the charger 263 of the power supply 260 so as to supply power to the controller 310 and the solenoid button 610 of the weight adjustment device 200.

The charger 263 may be mounted between the generator 250*s* or the external power source 510 and the converting switch 261, or between the converting switch 261 and the inverter 262.

At this time, the charger 263 may be an AC charger or a DC charger depending on its mounting position.

In addition, signal transmission between the controller 310 and the solenoid button 610 and/or between the controller 310 and the motor 700*b* may be realized using a wired manner or a wireless manner using a communication device.

The machine of the present invention configured as above may be installed as shown in FIG. 14. In this case, the power charged in the charger from the external power source is used at an initial exercising stage, and the power generated by the generator 250*a* is then charged and used with the exercise being progressed after the external power source is isolated.

If the weight-training machine of the present invention is used at a place without an external power source, a user operates the wire initially so that power is generated by the generator 250*a* and charged, and then the charged power allows the user to use the weight-training machine in a normal way.

Reference numeral 210 designates a plate for stacks.

FIGS. 15 and 16 show a stack for the weight-training machine according to the present invention. This stack 240 has a cubic shape with a certain weight. As shown in FIG. 17, a resin layer 240*c* is coated on the surface of a metal body 240*b* having a cubic shape. Guide holes 240*e* are vertically formed at both sides thereof. Stoppers 240*d* are protruded upward at four corners by a low height.

In addition, a insert recess 240*k* with a cubic shape is formed at the center of the side that forms a front surface 240*h*. This insert recess 240*k* makes the stack configure a "C" shape.

An insert groove 240*a* having a small rectangular size is also formed at the lower center of the side that is positioned in front of the insert recess 240*k*. This insert groove 240*a* is formed at the center of gravity of the stack 240.

In addition, edges of the front surface 240*h*, the side surface 240*j*, the rear surface 240*i* and the side surface 240*j*, positioned at both sides of the insert recess 240*k*, form a ¼ arc. Or, the side surface 240*j* forms an arc.

The fixing plate 220*b* inserted into the insert groove 240*a* forms a cubic shape with a size smaller than the insert groove 240*a*, as shown in FIGS. 17 and 18. The fixing plate 220*b* is combined in front of the button 230 as shown in FIG. 19.

The stacks 240 of the present invention, configured as above, are assembled as follows. At first, a plurality of stacks 240 are laminated on a buffer 28 of the base 110 by means of the guides 111, and then the plate 210 combined with the weight adjustment device 200 is seated on the upper surface 240*f* of the uppermost stack 240. In this state, if a button 230 corresponding to a desired weight among the buttons 230 is pushed, the corresponding fixing plate 220*b* is inserted into the insert hole 240*a* of the corresponding stack 240 so that the stack 240 to which the fixing plate 220*b* is inserted and stacks 240 above the stack 240 are moved up and down at the same time.

At this time, the fixing plate 220*b* is advanced without interference to the both sides and upper side of the insert hole 240*a* as shown in FIG. 17, and lifts up the stacks 240 corresponding to the selected weight with being surface-contacted with the upper surface of the insert groove 240*a* as shown in FIG. 18. In order to move down the stacks 240 after lifting-up, the fixing plate 220*b* is not contacted with the upper surface 240*f* of a stack 240 positioned below the stacks 240 corresponding to the selected weight, so impact is not transferred to the fixing plate 220*b*. The bottom surface 240*g* of the stack 240 positioned at the lowermost position among the lifted-up stacks 240 primarily absorbs impact by means of the stopper 240*d* formed on the upper surface of a stack 240 positioned below it, and impact is also relieved by means of the resin layer 240*c*.

Thus, the weigh adjustment device 200 having the number of buttons 230 corresponding to the number of stacks 240 is inserted into the insert recesses 240*k* of the stacks 240. In addition, the operation distance of the fixing plate 220*b* moving in combination with the button 230 becomes minimized. Moreover, since the operation distance is shortened, the fixing plate may be operated with a small amount of force, thereby allowing a one-touch manipulation. In addition, the insert groove 240*a* is formed at the center of gravity of the entire stacks 240 and prevents the stacks from being shaken right/left or up/down.

INDUSTRIAL APPLICABILITY

The present invention gives the following effects. First, since the rod-shaped generator and the pulley-shaped generator generate electricity by up/down movement of a user, power may be supplied to the solenoid button and the controller without external power. Second, the exercising effect is improved since the solenoid unit having the solenoid button is separated and the button unit having only a button is positioned at the front center of the stack, and since a pair of generators having a rod shape are vertically installed in parallel at both rear sides of the stack to balance of the overall stack. Third, the solenoid button may be operated using a conventional manual manner. Fourth, space limitation for installation of the machine, compared with a conventional machine that should be provided with external power. Fifth, since the solenoid unit is seated on the frame, the appearance is not deteriorated due to power lines.

In addition, since the power generated by the generator that generates power using movement of the wire when a user is exercising is charged in the charger of the power supply to operate the solenoid button or the motor, the machine may be used at any place. Moreover, since many stacks are used, a rotating amount of the motor of the weight adjustment device is decreased, so an exercising load may be controlled only using the power generated by the generator.

Furthermore, since the insert recess is formed at the front center of the stack, an operation distance between the fixing plate and the push button of the fixing device may be minimized, thereby shortening its length, so the fixing plate may be operated with a small amount of force. In addition, since the insert groove is formed at a position corresponding to the center of gravity of the stack and the fixing plate has a rectangular plate shape, the stacks are not shaken right/left or up/down on the basis of the fixing plate and the insert hole.

The invention claimed is:

1. A weight-training machine having an independent power generating function, which includes a plurality of stacks moving up and down by means of a pair of guides mounted vertically, a button unit disposed at a front center of the stacks and having the number of solenoid buttons corresponding to the number of the stacks and buttons inserted into insert holes of the stacks, and a wire guided by pulleys mounted to a frame, wherein a solenoid unit having the solenoid buttons is separated from the button unit so that the solenoid buttons are installed to a position adjacent to heads of the buttons, wherein the buttons are moved forward and backward electrically or manually, wherein a pair of generators having a rod shape are installed at both rear sides of the stacks so as to be parallel to each other vertically with a predetermined distance, and wherein a power supply is installed below the generators so that the power supply is electrically connected to the generators and the solenoid unit.

2. The weight-training machine according to claim 1, wherein the generator includes a pipe having a coil wound in contact with an inner side thereof, and a magnetic rod combined to be movable in a length direction along inside of the coil and composed of a plurality of permanent magnets so that positive and negative poles are alternately laminated, whereby the generator generates power by means of movement of the permanent magnets when reciprocating in the coil in a length direction along a selected stack.

3. The weight-training machine according to claim 1, wherein the power supply includes a converting switch provided with electric power selectively from the generators and an external power source, an inverter for converting AC supplied from the converting switch into DC, and a charger for charging the supplied DC.

4. The weight-training machine according to claim 3, wherein a sensor for sensing operation of the solenoid button is mounted to the solenoid unit, wherein a sensor is installed to a controller to operate a selected solenoid button so that the button is inserted into an insert groove of the stack, wherein the sensor senses manual operation of the solenoid button to make the controller display a current exercising weight, wherein the sensor senses a user to be in an exercising position so that the controller is operated when the user is in the exercising position and the power is automatically isolated when the user takes off from the exercising position.

5. The weight-training machine according to claim 1, wherein a generator is further installed to one of the pulleys.

6. The weight-training machine according to claim 1, wherein a sensor for sensing operation of the solenoid button is mounted to the solenoid unit, wherein a sensor is installed to a controller to operate a selected solenoid button so that the button is inserted into an insert groove of the stack, wherein the sensor senses manual operation of the solenoid button to make the controller display a current exercising weight, wherein the sensor senses a user to be in an exercising position so that the controller is operated when the user is in the exercising position and the power is automatically isolated when the user takes off from the exercising position.

* * * * *